United States Patent [19]

De Fabritis

[11] 4,033,462

[45] July 5, 1977

[54] ARTICLE SUPPORT/DISPLAY DEVICE

[76] Inventor: Diana C. De Fabritis, Aunt Hack Road, Danbury, Conn. 06810

[22] Filed: Apr. 30, 1976

[21] Appl. No.: 681,795

[52] U.S. Cl. ..... 211/94; 211/96; 211/162; 248/290; 248/307

[51] Int. Cl.[2] ..... A47F 5/08

[58] Field of Search ..... 211/94, 94.5, 96–102, 211/123, 162, 171–173, 105.1, 105.2; 248/215, 290, 294, 298, 301, 303, 304, 307

[56] References Cited

UNITED STATES PATENTS

| | | | |
|---|---|---|---|
| 109,648 | 11/1870 | Myers | 211/100 X |
| 113,129 | 3/1871 | Andrus et al. | 211/99 X |
| 193,164 | 7/1877 | Koon | 211/100 |
| 284,286 | 9/1883 | Downing | 211/171 |
| 395,775 | 1/1889 | French | 211/101 |
| 796,676 | 8/1905 | Rogers | 211/96 |
| 1,163,101 | 12/1915 | Megill | 248/290 X |
| 1,497,209 | 6/1924 | Chapman | 211/100 |
| 1,604,400 | 10/1926 | Fischer | 211/123 X |
| 1,800,387 | 4/1931 | Greist | 211/94 X |
| 2,967,624 | 1/1961 | Spellman | 211/100 |

FOREIGN PATENTS OR APPLICATIONS

| | | | |
|---|---|---|---|
| 563,383 | 9/1923 | France | 211/100 |
| 15,635 | 3/1906 | Norway | 211/96 |
| 14,433 | 6/1910 | United Kingdom | 211/94 |

*Primary Examiner*—Lawrence J. Staab
*Attorney, Agent, or Firm*—Mattern, Ware, Davis and Stoltz

[57] ABSTRACT

By providing a plurality of supported hooks, each being pivotably and slidably adjustable between various supported positions, a unique article supporting and displaying device is provided for accommodating various articles regardless of their size and shape. In the preferred embodiment, the device incorporates a plurality of rows, with each row having a plurality of hooks, thereby maximizing the storage area. Furthermore, the extended length of the hooks in each row are preferably staggered, with the lower rows incorporating shorter hooks, in order to prevent interference and increase the storage capacity.

14 Claims, 6 Drawing Figures

FIG. 1
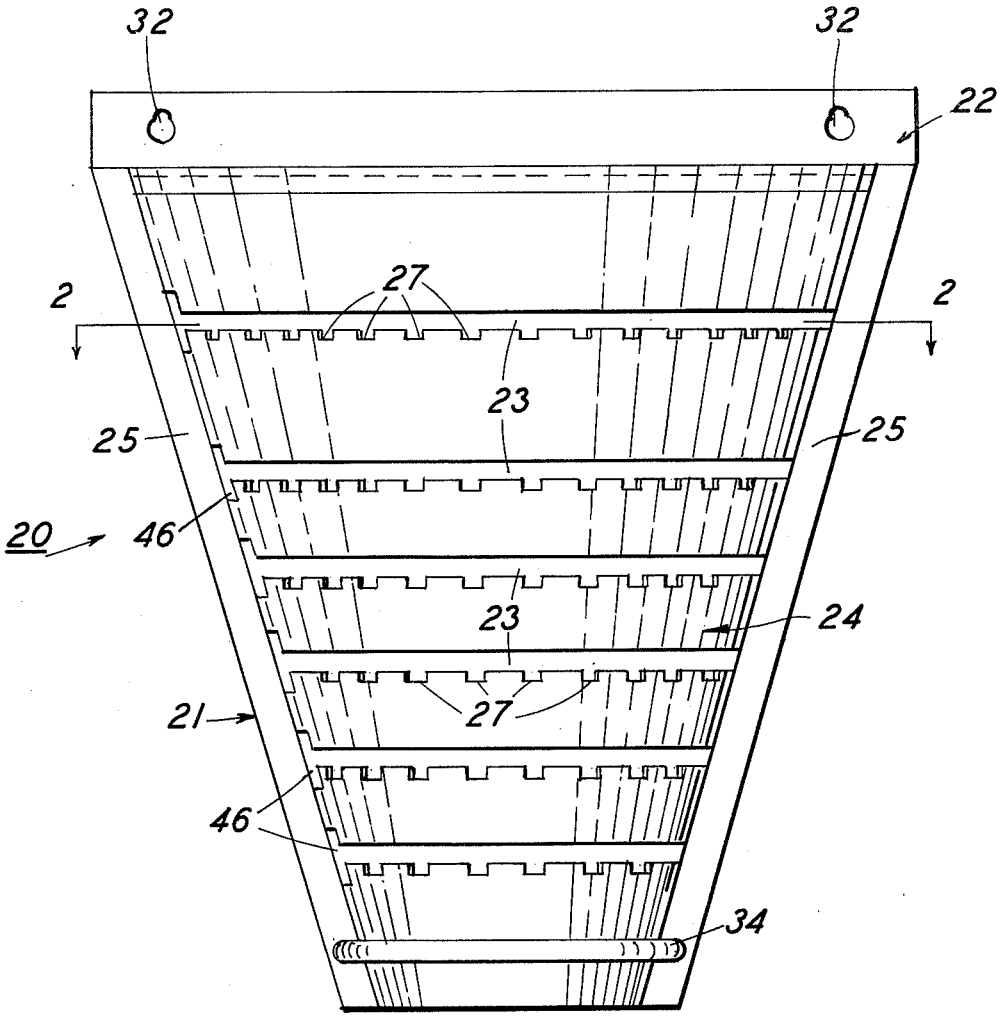
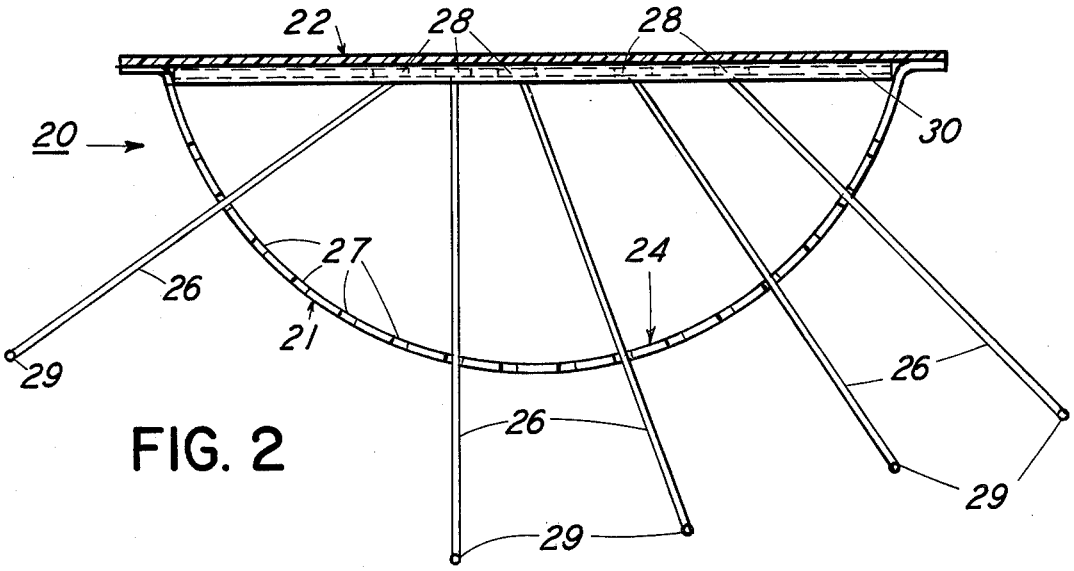
FIG. 2

ARTICLE SUPPORT/DISPLAY DEVICE

BACKGROUND OF THE INVENTION

This invention relates to supporting devices, and more particularly to supporting devices for displaying or storing a plurality of articles.

Although a variety of items have been displayed or supported on various hook constructions, all of these supporting and displaying devices suffer from the common drawback that the hook upon which the item is supported or displayed is either fixed and totally immovable, or is merely capable of pivoting from side to side. As a result, its supporting or displaying device is only usable for items of similar size and shape.

Another drawback commonly found in prior art supporting and displaying devices is the fact that such devices are constructed with no more than two rows. The only devices upon which more than two rows are employed is when the article being supported will not extend over or otherwise interfere with the lower rows. As a result, the versatility and usability of such devices has been hampered and is confined to a small segment of products.

Therefoe, it is a principal object of this invention to provide a support or display device wherein the supporting hooks are easily maneuverable between a plurality of different positions.

Another object of this invention is to provide a support or display device having the features described above wherein a plurality of varying sized items can be easily supported thereon.

Another object of this invention is to provide a support or display device having the features described above which is capable of supporting a plurality of items on a plurality of rows without any interference being caused by items extending below the plane of the lower rows.

A further object of this invention is to provide a support or display device having the features described above wherein the device is quickly and easily mountable in any convenient location.

Other and more specific objects will in part be obvious and will in part appear hereinafter

SUMMARY OF THE INVENTION

The support/display device of the present invention completely eliminates all of the prior art difficulties by providing a plurality of rows of supporting hooks, with each of the hooks in each of the rows being slidably engaged within a track at the proximal end of the hook. In this way, each of the plurality of hooks in each row is capable of being moved from one supported position to any alternative supported position desired by the user. Consequently, the hooks can be spaced apart from each other with any separation gap desired by the user in order to accommodate any size or shape item being placed on the distal end of the hook.

In the preferred embodiment, the support/display device of the present invention incorporates a plurality of parallel rows having hooks of progressively deceasing length in each lower row. In this way, items supported on the top row of hooks which extend downwardly through the horizontal planes of the lower rows will not abut or in any way otherwise interfere with the hooks of the lower rows, while also providing maximum storage capacity. However, if desired, the hook may be of substantially the same length with the variable horizontal position of the hooks being used in order to prevent any overlapping difficulty from items supported on a higher row and extending downwardly through the planes of the lower rows.

The invention accordingly comprises a product possessing the features, properties and relation of components which will be exemplified in the product hereinafter described, and the scope of the invention will be indicated in the claims.

THE DRAWINGS

For a fuller understanding of the nature and objects of the invention, reference should be had to the following detailed description taken in connection with the accompanying drawings, in which:

FIG. 1 is a front elevation view of the support/display device of the present invention;

FIG. 2 is a top plane view of the support/display device of the present invention taken along line 2—2 of FIG. 1.

DETAILED DESCRIPTION

Figure 3:
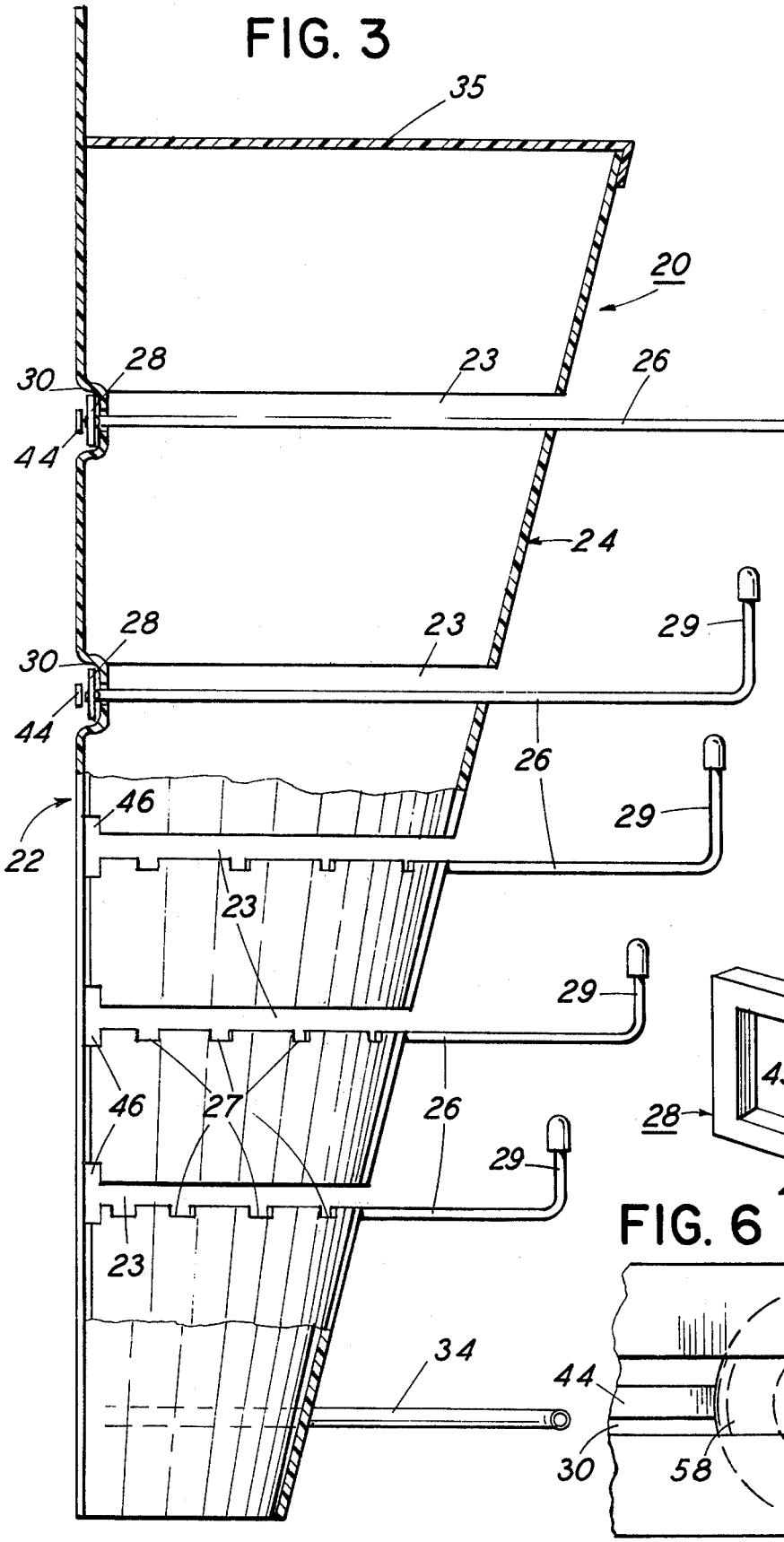
FIG. 3 is a side elevation view, partially broken away, of the support/display device of the present invention.

In FIGS. 1 and 2, the article support/display device 20 of te present invention is shown comprising a housing 21 which incorporates a rear portion 22 and a front, convexly curved portion 24. Rear portion 22 incorporates a plurality of tracks 30, while front portion 24 incorporates a plurality of tracks 23, in juxtaposed spaced relationship to tracks 30, with each track 23 having a plurality of hook supporting zones or cutouts 27. Support/display device 20 also incorporates a plurality of elongated hook members 26 which are slidably engaged in track 30 at their proximal end, and extend therefrom through track 23 with hook portions 29 spaced forward of front portion 24.

Front portion 24 is maintained in its concavely disposed arrangement by securely mounting its substantially flat, side edges 25 directly to rear portion 22. Although edges 25 of front portion 24 can be secured to rear portion 22 using a variety of different fastening methods, in the preferred embodiment, edges 25 are secured to rear portion 22 by direct bonding or by screw means. In this way, the secure, integrated relationship required for providing the strength and rigidity needed for this construction is assured.

For added convenience and ease of installation, the preferred embodiment of rear portion 22 also incorporates keyhole slots 32. Keyhole slots 32 are adapted for cooperation with fastening means, such as screws and nails, which are secured to a support wall. In this way, support/display device 20 can be easily mounted and securely retained in position on a wall or other convenient holding member. Also, if desired, support/display device 20 also may incorporate a concavely curved bar 34 extending from one edge 25 to the other. With curved bar 34 spaced forward of concave portion 24, bar 34 can be employed for additional storage or display of articles which can be dropped over or otherwise supported on bar 34.

Although support/display device 20 can be employed for supporting or displaying a variety of articles, the remainder of the disclosure will specifically deal with belts and discuss the attributes of device 20 with reference to the support or display of the varying sizes and shapes of belts by securing the belt buckle on the hook member. Although belts will be emphasized in this disclosure, this discussion is purely for exemplary purposes only and is not intended in any way to limit the scope of this invention and the wide variety of articles, such as ties, manufactured articles which have been packaged for display purposes, and all similar types of clothing and hardware articles, all of which are capable of convenient suspension and display or storage on the support/display device 20 of the present invention.

As shown in FIGS. 2 and 3, elongated hook members 26 are individually secured to a sliding anchor member 28, with anchoring member 28 slidably engaged within track 30. As will be further amplified below, hook members 26 are secured at their proximal ends to anchoring members 28 in a manner which allows hook members 26 to be freely pivotable about a vertical axis. In this way, each hook member 26 can be easily positioned at any desired location along track 30 for convenient support in any of the plurality of cutouts 27 provided in tracks 23 of front surface 24.

With each hook member 26 secured at its proximal end in an anchoring member 28 and positioned in one of the desired cutouts 27 of track 23, hook member 26 is securely supported in its desired position ready for receipt of any article to be hung over hook portion 29 of elongated hook member 26. In the preferred embodiment, support zones or cutouts 27 of track 23 comprise a rectangular shape in order to facilitate their manufacture and provide a secure retention and supporting zone for the elongated body of hook member 26. However, as would be obvious to one skilled in the art, any alternative shape for cutout 27 can be employed.

Since each hook member 26 is positionable and securely supported in any one of a plurality of support cutouts 27 of track 23, support/display device 20 has complete manipulative flexibility which has heretofore been unattainable in prior art units. With this unique arrangement, hook members 26 can be staggered in a single row in a variety of different locations in order to accommodate any size or shape article to be supported or displayed thereon. Furthermore, since each of the plurality of rows of hook members 26 comprise substantially identical constructions, the lower rows of hook members 26 can be positioned in staggered offset arangements in order to provide free, unobstructed support of articles on the lower rows. Of course, this construction is particularly useful for the storage of belts, since belts are long and comprise a relatively small width. Consequently, a large quantity of belts can be stored or displayed on support/display device 20 of the present invention, regardless of their size or shape, with ease and simplicity using the flexibility and maneuverability of hook members 26 with their slidable and pivotable features providing the desired flexiblity.

As shown in FIG. 3, the preferred embodiment of support/display device 20 incorporates a front portion 24 which comprises a truncated conical shape with the largest radius being employed as the uppermost edge. In this way, support/display device 20 incorporates an overall shape which progressively decreases from top to bottom. In combination with the tapered, downwardly decreasing profile of front portion 24, the preferred embodiment of support/display device 20 also incorporates hook members 26 wherein the plurality of hooks in each lower row comprises an overall length less than the length of the hook members in the row directly above it. As a result, the length of hook members 26, measuring from rear portion 22, are staggered with the shortest length of hooks being housed in the lowest row and the longest hook members 26 being housed in the uppermost row. In this way, the packing density or the quantity of articles which can be stored on storage/display device 20 is substantially increased, since the articles depending from the hook members 26 directly above a lower row of hook members will not interfere with the articles supported on the hook members 26 in the lower row.

As mentioned above, support/display device 20 also incorporates convex ring 34 which extends about the lower portion of support/display device 20. Ring 34 is particularly useful for the storage of belts which do not have buckle portions that can be easily secured to hook members 26. This type of belt can be easily stored on device 20 by simply draping the belt over ring 34 for secure retention thereon.

Also, in the preferred embodiment, storage/display device 20 incorporates a cover plate 35 which is mounted to rear plate 22 and secured about the top edge of front portion 24. In this way, the collection of dust, dirt and other debris in the interior space between front portion 24 and rear portion 22 is eliminated, and a more aesthetically pleasing unit is provided. Of course, the inclusion of cover 35 is optional and does not affect the overall operability and unique capabilities of support/display device 20.

Figure 4:
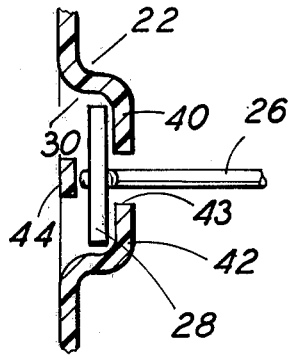
FIG. 4 is an enlarged cross-sectional side elevation view of detail 4 of FIG. 3 showing the sliding anchoring member in the elongated track used in the support/display device of the present invention.

As best seen in FIG. 4, track 30 is formed in rear portion 22 by cutting rear plate 22 along a major portion thereof to form elongated arms 40 and 42 which are then bent or stamped into position in juxtaposed spaced relationship, forward of the overall plane of rear portion 22, in an embracing configuration. Elongated bar 44 remains in the same plane as rear portion 22, defining the rear of track 30.

When anchroing member 28 is positioned within track 30, with hook member 26 pivotably secured thereto, hook member 26 and anchoring member 28 freely slide along the length of track 30 confined and retained in this position by the rear surface of arms 40 and 42 and the front surface of elongated bar 44. To further enhance the secure, supported retention of hook member 26, hook member 26 can rest on the top edge 43 of arm 42, thereby providing added support to hook member 26 when it is loaded with articles.

The construction of track 30, with embracing arms 40 and 42 being integrally formed from rear portion 22 to provide an integral, unitary, homogeneous member, is preferred for the inherent stability provided and the relatively inexpensive manufacturing costs incurred. However, alternative track constructions can be employed, such as mounting a separate track assembly to the rear portion or forming other type of track assemblies on the rear portion. These alternative constructions are clearly within the scope of this invention and the specific construction defined in detail is purely for exemplary purposes and is not intended in any way to limit the scope of the present invention.

As shown in FIG. 4, the terminating edges of arms 40 and 42 are in juxtaposed facing relationship with a gap formed therebetween. It is through this gap that anchoring members 26 extend, from their proximal end securement about anchoring member 28, forwardly to the extent of their length. As will be more fully described below, each hook member 26 is peripherally wrapped around and retained by a vertical post of anchoring member 28. As a result, hook member 26 is free to pivot about the vertical axis defined by the vertical post, but is not capable of pivoting about any other axis. Consequently, each hook member 26 freely slides and pivots from side to side in the gap formed between arms 40 and 42 for easy engagement in any of the supporting cutouts 27 formed in track 23 of front portion 24.

By referring to FIGS. 1, 3 and 4, the installation and slidability of anchoring member 28 in track 30 can best be understood. In the preferred embodiment, each track 23 incorporates an enlarged slot 46 at one terminating end thereof. Once hook member 26 is securely positioned on anchoring member 28, anchoring member 28 is inserted through slot 46 into secure sliding engagement within track 30. Once located within track 30, anchoring member 28 is freely slidable along the entire track secured in the slidable position by arms 40 and 42 and elongated bar 44. The installation is completed by sliding anchoring member 28 and hook member 26 to the end of track 30 opposite entry slot 46, and then repeating the insertion and sliding process until all of the hook members 26 and anchoring members 28 have been positioned in track 30 at that desired level. Once the process has been repeated for all of the additional tracks of storage/display device 20, the unit is completed and ready for receipt of the particular articles thereon.

Figure 5:
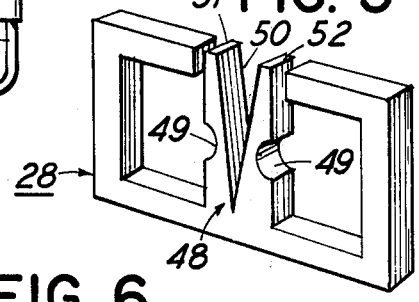
FIG. 5 is a perspective view of one embodiment for the anchoring member.

In FIG. 5, the details of the preferred embodiment of anchoring member 28 can best be seen. In this preferred embodiment, anchoring member 28 incorporates a central vertical supporting post 48 having formed therein notches 49 on opposed sides thereof for secure retention of a hook member 28. The remainder of anchoring member 28 comprises an overall rectangular configuration.

In this embodiment, the top of central post 48 is not attached to the remainder of the rectangular frame forming the anchoring member 28. Furthermore, post 48 incorporates a notch 50 in its top surface, forming legs 51 and 52 in post 48. In this way, the proximal end of hook member 26 can be formed into a closed loop or hook eye, and then installed on post 48 by inserting the closed loop over the top end of post 48 and pushing the loop downwardly until it securely rests in notches 49.

Since notch 50 in the top of post 48 forms legs 51 and 52, the closed loop of the hook member 26 can be easily inserted over post 48 by pressing legs 51 and 52 close together in order to allow the closed loop of hook member 26 to be easily inserted thereover. Once the hook eye has been positioned about legs 51 and 52 of post 48, hook member 26 can be easily slipped downwardly until securely retained in notches 49 of post 48.

Of course, if desired, anchoring member 28 can incorporate a rectangular frame with post 48 connected to the frame structure. In this alternative embodiment, hook member 26 would have its proximal end bent or otherwise formed directly about post 48.

When in position, hook member 26 is freely pivotable about the vertical axis defined by post 48 for ease of usability and flexibility in support/display device 20. The remaining rectangular configuration of anchoring member 28 incorporates a dimensional configuration which imparts to anchoring member 28 the freely slidable characteristic required in order to properly function when mounted within track 30.

Figure 6:
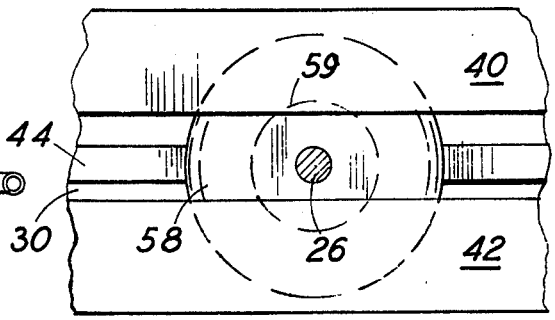
FIG. 6 is a front elevation view of an alternative embodiment of the anchoring member in the track.

In FIG. 6, an alternative embodiment for the anchoring member is shown. In this embodiment, anchoring member 58 comprises a cricular configuration. Hook member 26 is rotatably or pivotally secured to base 59 at its proximal end, and then inserted through circular anchoring member 58 until its proximal end is securely retained and at the rear thereof. When hook member 26 is mounted to anchoring member 58, the anchoring member 58 is then inserted in track 30 for sliding engagement therewith.

Although the embodiments discussed above for the anchoring member are preferred, it should be obvious to one skilled in the art that a plurality of various configurations and attachment methods for hook member 26 are possible without departing from the scope of this invention.

It will thus be seen that the objects set forth above among those made apparent from the preceding description, are efficiently attainted and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetwen.

Having described my invention, what I claim as new and desire to secure by Letters Patent is:

1. An article holding device comprising:

A. a first portion incorporating a plurality of elongated tracks;

B. a second portion incorporating a. a front surface in juxtaposed spaced relationship to said first portion and slanted with respect thereto with the lower edge of the front surface closer to said first portion than the upper edge of the front surface, and b. a plurality of hook support zones formed in the front surface in juxtaposed spaced relationship to said elongated track;

C. a plurality of anchoring members slidably engaged engaged within the elongated tracks of the first portion; and D. a plurality of sets of hook members a. individually secured at one end thereto to one of said anchoring members and extending therefrom to a forward holding position with a portion thereof engaging said support zone of said second portion, b. each member of a set having a substantially equal length, and at least two of said sets having different lengths, and c. each set of hook members being engaged in one of said tracks with the shortest length set engaged in the track wherein the distance between the second portion and the first portion is the smallest, and the longest length set engaged in the track wherein the distance between the second portion and the first portion is the largest;

whereby said hook members can be positioned at any location along the track for variable engagement in a plurality of different positions along said hook support zone thereby enabling articles depending from one set of hook members to be positionable thereon without interfering with any other set of hook members.

2. The article holding device defined in claim 1, wherein said second portion comprises a concave surface forming the major part thereof, terminating on both sides with a substantially flat mounting plate for integral attachment to said first portion.

3. The article holding device defined in claim 2, further comprising a convex ring a. in juxtaposed spaced facing relationship with the concave surface of the second portion, and b. secured at its terminating ends of the flat mounting plates of the second portion.

4. The article holding device defined in claim 1, wherein said second portion comprises a truncated conical shape and is secured to said first portion at the terminating ends thereto.

5. The article holding device defined in claim 1, wherein said hook support zone is further defined as comprising an elongated track.

6. The article holding device defined in claim 5, wherein said elongated track defining said hook support zone is further defined as incorporating a pluralituy of cutout areas wherein said hook member can be securely positioned.

7. The article holding device defined in claim 1, wherein said track is further defined as comprising a forwardly disposed restraining arm incorporating a. an elongated platform for sliding engagement with said anchoring member, and b. an elongated restraining ridge for containing said anchoring member.

8. The article holding device defined in claim 7, wherein said track is further defined as comprising two forwardly disposed containing arms in juxtaposed spaced relationship to each other both of which being formed from said first portion, providing an integral, homogeneous unitary structure.

9. The article holding device defind in claim 1, wherein said second portion is further defined as comprising a portal zone a. formed at the terminating end of said hook support zone, and b. communicating with said elongated track of the first portion, whereby the anchoring member is easily insertable into said track through said portal zone and removable therethrough.

10. The article holding device defined in claim 1, wherein each of said anchoring members is further defined as comprising a vertical hook retaining post for supporting attachment with the proximal end of one of said hook members.

11. The article holding device defined in claim 10, wherein said vertical hook retaining post incorporates securement zones for secure, slip-free retention of said hook member, and the hook member is looped about said vertical retaining post secured within said securement zones, whereby said hook member is securely retained on said post while also being pivotable about the central axis thereof.

12. The article holding device defined in claim 10, wherein said anchoring member is further defined as comprising an overall rectangular shape.

13. The article holding device defined in claim 12, wherein said anchoring member is further defined as comprising a vertical hook retaining post which has a free end at its top for easy engagement of said hook member thereover.

14. The article holding device defined in claim 1, wherein said anchoring member comprises a circular shape.

* * * * *